US011623264B2

(12) United States Patent
Cho et al.

(10) Patent No.: US 11,623,264 B2
(45) Date of Patent: Apr. 11, 2023

(54) PRESS MOLD

(71) Applicants: Hyundai Motor Company, Seoul (KR); Kia Corporation, Seoul (KR)

(72) Inventors: Jong Kun Cho, Ulsan (KR); Tae Jong Yoon, Ulsan (KR); Nam Yong Song, Busan (KR)

(73) Assignees: Hyundai Motor Corporation, Seoul (KR); Kia Corporation, Seoul (KR)

( * ) Notice: Subject to any disclaimer, the term of this patent is extended or adjusted under 35 U.S.C. 154(b) by 25 days.

(21) Appl. No.: 17/390,218

(22) Filed: Jul. 30, 2021

(65) Prior Publication Data

US 2022/0193750 A1 Jun. 23, 2022

(30) Foreign Application Priority Data

Dec. 21, 2020 (KR) ..... 10-2020-0179847

(51) Int. Cl.
*B21D 37/10* (2006.01)

(52) U.S. Cl.
CPC ..... *B21D 37/10* (2013.01)

(58) Field of Classification Search
CPC ..... B21D 37/10; B21D 22/02; B21D 22/06; B21D 22/10; B21D 11/20
See application file for complete search history.

(56) References Cited

U.S. PATENT DOCUMENTS

| | | | | |
|---|---|---|---|---|
| 2,980,046 A * | 4/1961 | McGregor | ..... | B21D 37/10 72/414 |
| 4,856,399 A * | 8/1989 | Deshet | ..... | B21D 22/10 83/685 |
| 2002/0095968 A1* | 7/2002 | Matsunaga | ..... | B21D 22/02 72/350 |
| 2010/0018280 A1* | 1/2010 | Maeda | ..... | B21D 22/02 72/358 |

FOREIGN PATENT DOCUMENTS

| | | |
|---|---|---|
| JP | 3419269 B2 | 6/2003 |
| KR | 10-2031026 B1 | 10/2019 |

* cited by examiner

*Primary Examiner* — Teresa M Ekiert
(74) *Attorney, Agent, or Firm* — Morgan, Lewis & Bockius LLP

(57) ABSTRACT

A press mold for forming a panel, may include an upper die for vertically operating by an upper press, and having a mounting recess recessed upward at a lower surface central portion, a lower die disposed under the upper die, and configured to the vertically operate by a lower press, an upper pad disposed in a center portion of the mounting recess, and formed with an upper forming surface at a lower surface edge portion, a lower steel disposed under the upper pad, mounted on the lower die, and formed with a lower forming surface at an upper surface edge portion of the lower steel corresponding to the upper forming surface, and an upper steel mounted on the upper die at a position exterior to the lower forming surface.

15 Claims, 5 Drawing Sheets

PRESS MOLD

CROSS-REFERENCE TO RELATED APPLICATION

The present application claims priority to Korean Patent Application No. 10-2020-0179847 filed on Dec. 21, 2020, the entire contents of which is incorporated herein for all purposes by this reference.

BACKGROUND OF THE INVENTION

Field of the Invention

The present invention relates to a press mold.

Description of Related Art

In general, to manufacture a vehicle, 20,000 to 30,000 component parts are assembled through many assembly processes.

As a first step of a vehicle manufacturing process, various intermediate products including formed panels and/or formed beams are produced through various types of press processing, and then assembled to a vehicle body factory to form a vehicle body in a body in white (BIW).

The press processing is highly productive and efficient among metal processing technologies.

In addition, the press processing enables the production of products with uniformity, and the strength is strong compared to the light weight while consuming the material economically.

In such press processing, molds including upper and lower molds disposed in a vertical direction are provided in the press, respectively, and after loading the panel between the upper and lower molds of the press, the panel is stamped to be formed into a molded product of a preset shape.

In the present press processing method, processing such as drawing, flanging, restriking, and forming, are sequentially performed, and various products from small and simple component parts to large and complex-shaped component parts may be mass-produced relatively easily.

As a problem that occurs in the press processing process of the panel is, for example, a quality defect due to insufficient smoothness or roughness of the formed surface may occur.

In more detail, in the press processing method according to related art, the panel is loaded between the upper mold and the lower mold, the panel is fixed by the combination of the upper and lower mold, and then the panel is formed by an upper steel or a lower steel.

Depending on the match between the panel and pressurizing surfaces of the upper and lower molds, defects in the formed surface may occur after the press processing.

Therefore, in the conventional method, when defects in the formed surface occur, the pressed product is post-processed by manual processing of workers to secure product quality.

The manual processing consumes considerable work time without securing uniformity of quality, and increase production cost.

The information disclosed in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a press mold for forming a panel where a urethane pad is formed along an upper forming surface that directly contacts with the panel, and thereby a perfect match is achieved between the panel, the upper forming surface, and the lower forming surface, preventing possibility of defect of the formed surface, and removing a manual post-processing.

A press mold for forming a panel, may include an upper die for vertically operating by an upper press, and having a mounting recess recessed upward at a lower surface central portion, a lower die disposed under the upper die, and configured to the vertically operate by a lower press, an upper pad disposed in a center portion of the mounting recess, and formed with an upper forming surface at a lower surface edge portion, a lower steel disposed under the upper pad, mounted on the lower die, and formed with a lower forming surface at an upper surface edge portion of the lower steel corresponding to the upper forming surface, and an upper steel mounted on the upper die at a position exterior to the lower forming surface.

A urethane pad of a preset thickness may be formed on the upper forming surface to contact with the panel.

The preset thickness may be set in a range of 5 mm to 15 mm.

The urethane pad may be formed on the upper forming surface to preset thickness by 3D printing.

The urethane pad may be bonded on the upper forming surface through a heat-resistant adhesive member that withstands a temperature range of 100° C. to 400° C.

A plurality of filling grooves may be formed on the upper forming surface of the upper pad to form a surface roughness.

The plurality of filling grooves may be filled with a urethane material.

The plurality of filling grooves may be formed in a slot shape and arranged in parallel in a direction toward a center portion of the upper pad.

The upper pad may be externally formed with a position regulation recess on a lateral side thereof. A side pin may be mounted in an internal side of the upper die and detachably coupled with the position regulation recess to regulate a vertical position of the upper pad.

The upper pad may be configured to apply a pressure to the panel by being elastically supported in a vertical direction by an elastic unit mounted in the mounting recess.

The elastic unit may include a plurality of gas springs of which pressure is adjusted by a pressure control device.

The pressure control device may include, a controller mounted in an internal side of the upper die, a plurality of pipes connected to the controller and also connected to the plurality of gas springs, and a sensing portion connected to the controller through the plurality of pipes, and configured to sense a gap between the upper forming surface and the lower forming surface.

The upper steel may be fitted to an outside of the lower steel, and formed with an external shape forming surface at an internal side to form an external shape of the panel.

The upper steel may be mounted on a stepped surface stepped downwardly from the mounting recess, and vertically movable along an external surface of the lower steel together with the upper die.

According to various exemplary embodiments of the present invention, the urethane pad is formed along the upper forming surface that directly contacts with the panel, and thereby a perfect match is achieved between the panel, the upper forming surface, and the lower forming surface. Therefore, possibility of defect of the formed surface may be prevented, and a manual post-processing is not necessary.

Accordingly, the press mold according to various exemplary embodiments of the present invention may enable fully automated forming of the panel.

Other effects which may be obtained or are predicted by an exemplary embodiment will be explicitly or implicitly described in a detailed description of the present invention. That is, various effects that are predicted according to an exemplary embodiment will be described in the following detailed description.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
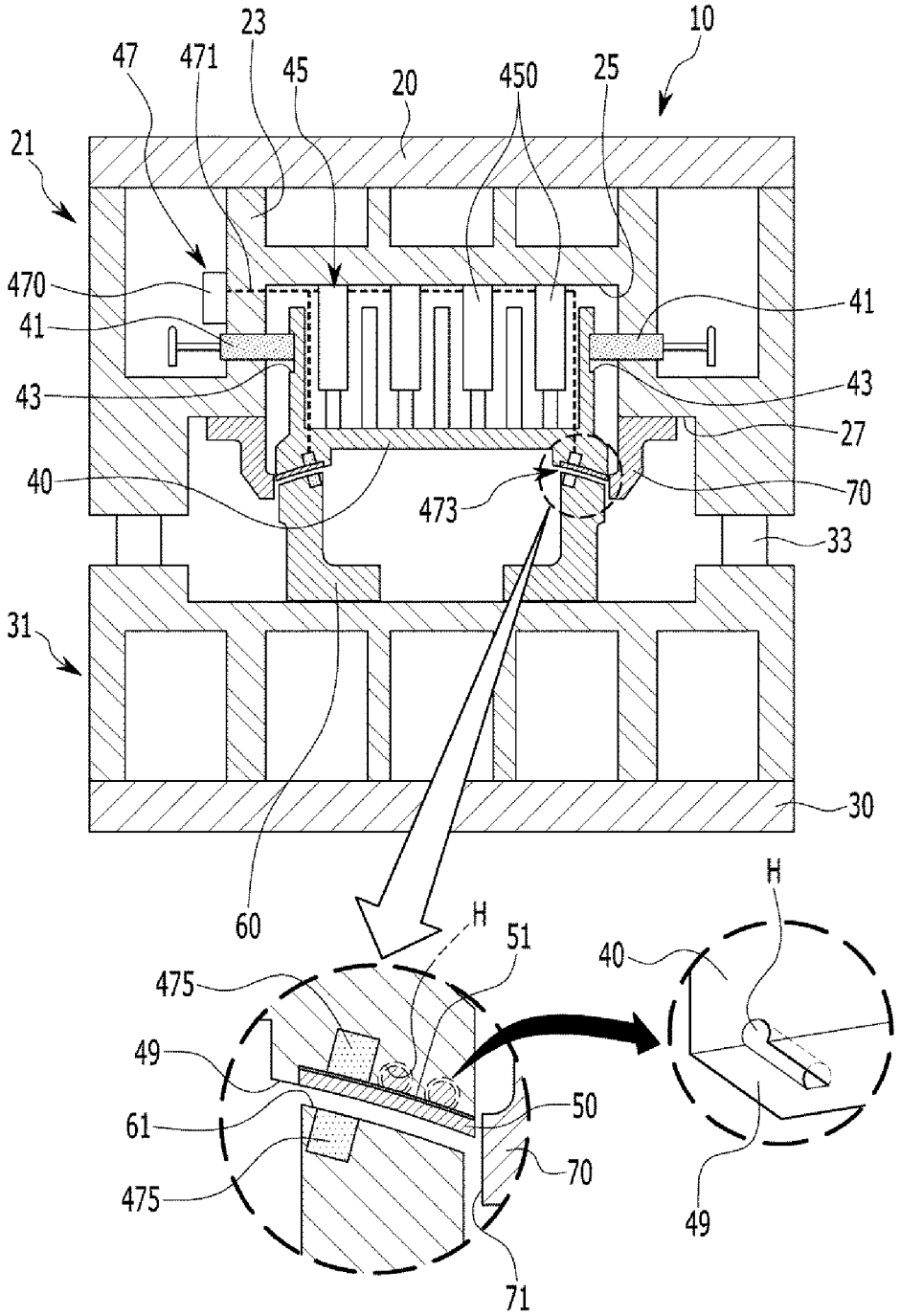
FIG. 1 is a schematic diagram of a press mold according to various exemplary embodiments of the present invention.

It may be understood that the appended drawings are not necessarily to scale, presenting a somewhat simplified representation of various features illustrative of the basic principles of the present invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Exemplary embodiments of the present application will be described more fully hereinafter with reference to the accompanying drawings, in which exemplary embodiments of the present invention are shown. As those skilled in the art would realize, the described embodiments may be modified in various different ways, all without departing from the spirit or scope of the present invention.

Typically, a vehicle length direction thereof, i.e., a moving direction of a vehicle in an assembly line, is called a T direction thereof, a width direction of the vehicle is called an L direction thereof, and a vehicle height direction is called an H direction thereof.

However, in various exemplary embodiments of the present invention, front and rear, left and right, and up and down directions in the drawing are taken as reference directions, instead of taking the LTH directions as reference directions.

The above definition of reference directions has relative meanings, and may not necessarily limited thereto since directionality may vary depending on reference positions of the exemplary apparatus or constituent parts employed therein Hereinafter, with reference to the drawings, a portion facing upward is called an upper portion, an upper end, an upper surface, and an upper end portion, a portion facing downward is called a lower part, a lower end, a lower surface, and a lower end portion.

In addition, hereinafter, an "end (one end, another end, and the like)" may be defined as any one end or may be defined as a portion (one end portion, another end portion, and the like) including that end.

FIG. 1 is a schematic diagram of a press mold according to various exemplary embodiments of the present invention.

A press mold 10 according to various exemplary embodiments of the present invention may be used, for example, to form a component part applied to a vehicle.

The press mold 10 molds a panel 1 under conditions of high temperature over 200° C.

The press mold 10 may apply, to the panel 1, trimming, flanging, restriking, and forming, to form the panel 1 to a desired shape.

For such a purpose, referring to FIG. 1, the press mold 10 according to various exemplary embodiments of the present invention includes an upper die 21, a lower die 31, an upper pad 40, a lower steel 60, and an upper steel 70.

The upper die 21 is configured to vertically operate by an upper press 20.

The upper die 21 includes a body 23 having a plurality of partitioned spaces therein.

A mounting recess 25 recessed upward is formed at a lower surface center portion of the upper die 21.

The lower die 31 is disposed under the upper die 21.

The lower die 31 is configured to vertically operate by a lower press 30.

A damping member 33 may be configured between the upper die 21 and the lower die 31.

The damping member 33 prevents direct contact between the upper die 21 and the lower die 31.

The upper pad 40 is disposed in a center portion of the mounting recess 25 of the upper die 21.

The upper pad 40 may be mounted to vertically operate with respect to the body 23 through a side pin 41 and an elastic unit 45.

The side pin 41 is mounted in an internal side of the body 23 of the upper die 21, and is provided with respect to each of both lateral side of the upper pad 40.

The upper pad 40 is externally formed with a position regulation recess 43 at each of both the lateral sides. The side pin 41 is coupled with (e.g., inserted into) the position regulation recess 43, and thereby vertical position of the upper pad 40 may be regulated.

This side pin 41 may be detachably mounted to be used when needed.

The upper pad 40 is elastically supported in the vertical direction by the elastic unit 45 mounted in the mounting recess 25, and thereby configured for applying pressure to the panel 1.

At the present time, the elastic unit 45 includes a plurality of gas springs 450 of which pressure is adjusted by a pressure control device 47.

The plurality of gas springs 450 may be disposed at preset intervals in the upper portion of the upper pad 40.

The pressure control device 47 includes a controller 470, pipes 471, and a sensing portion 473.

The controller 470 is mounted in an internal side of the body 23 of the upper die 21.

Furthermore, the plurality of pipes 471 are connected to the controller 470, and also connected to the plurality of gas springs 450.

Furthermore, the sensing portion 473 is configured at a frontal end portion (illustrated as a bottom end portion in FIG. 2) of the plurality of pipes 471, and is connected to the controller 470 through the plurality of pipes 471.

The sensing portion 473 is mounted between the upper pad 40 and the lower steel 60.

The sensing portion 473 is configured to sense a gap between the upper pad 40 and lower steel.

The controller 470 may adjust the pressure supplied to the gas spring 450, based on a sensed value of the sensing portion 473.

By adjusting the pressure of the gas spring 450, the gap between the upper pad 40 and the lower steel 60 may be adjusted.

Furthermore, the upper pad 40 may be formed as a steel material.

An upper forming surface 49 is formed at a lower surface edge portion of the upper pad 40.

The upper forming surface 49 may be formed as a surface inclined downward toward the outside.

A plurality of filling grooves H may be formed on the upper forming surface 49 to form a surface roughness.

At the present time, the filling grooves H have a diameter on the opening side smaller than a largest diameter inside. That is, in a direction vertical to FIG. 1, the filling groove H is formed with a preset length, and a diameter of an opening end portion of each filling groove H is smaller than a largest diameter within the preset length of the filling groove H.

Furthermore, the filling grooves H are arranged in parallel in a direction toward a center portion of the upper pad 40.

For example, the filling grooves H may be formed in a slot shape.

The filling grooves H may be formed along the upper forming surface 49 on the external surface of the upper pad 40.

The filling grooves H may be formed from the outside of the upper pad 40 by use of a drill or the like.

A urethane pad 50 of a preset thickness is formed on the upper forming surface 49, for example, by coating a urethane material.

At the present time, the urethane pad 50 may be formed in a preset thickness in a range of 5 mm to 15 mm.

The urethane pad 50 may be directly formed on the upper forming surface 49 by 3D printing.

The urethane pad 50 may be bonded on the upper forming surface 49 through a heat-resistant adhesive member 51 that withstands a temperature range of 100° C. to 400° C.

The adhesive member 51 is to apply a bonding technique with heat-resistance at high temperature between different materials (that is, steel and urethane). The adhesive member 51 may sufficiently withstand the heat applied during operation of the press mold 10 according to various exemplary embodiments of the present invention.

This urethane material may be filled in the filling grooves H formed on the upper forming surface 49.

Accordingly, the urethane pad 50 may secure adhesiveness to the upper pad 40 through the adhesive member 51 and the process of filing the urethane material the filling grooves H The lower steel 60 disposed under the upper pad 40.

The lower steel 60 is mounted on the lower die 31.

The lower steel 60 is formed with a lower forming surface 61 at an upper surface edge portion of the lower steel corresponding to the upper forming surface 49.

The lower forming surface 61 may be formed as a surface inclined downward toward the outside.

Furthermore, FIG. 1 illustrates two sensors 475 one of which is attached to the lower forming surface 61 of the lower steel 60 and another of which is attached to the upper pad 40. The two sensors 475 may form the sensing portion 473.

That is, through the two sensors 475 mounted in positions facing each other at the upper forming surface 49 and the lower forming surface 61, the sensing portion 473 senses the gap between the upper forming surface 49 and the lower forming surface 61.

That is, the sensing portion 473 is configured to sense the thickness of the panel 1 and the urethane pad 50.

The upper steel 70 is disposed at a position exterior to the lower forming surface 61.

The upper steel 70 may be mounted on the upper die 21.

In more detail, the upper steel 70 may be mounted on a stepped surface 27 stepped downwardly from the mounting recess 25 of the upper die 21.

The upper steel 70 is fitted to an outside of the lower steel 60 through a penetration hole formed at a center portion, and vertically operates along the external surface of the lower steel 60 according to the operation of the upper die 21, i.e., together with the upper die 21.

The upper steel 70 may be formed with an external shape forming surface 71 at an internal side to form an external shape of the panel 1.

FIG. 2, FIG. 3, FIG. 4 and FIG. 5 are operation diagrams sequentially showing the operation of a press mold according to various exemplary embodiments of the present invention.

Figure 2:
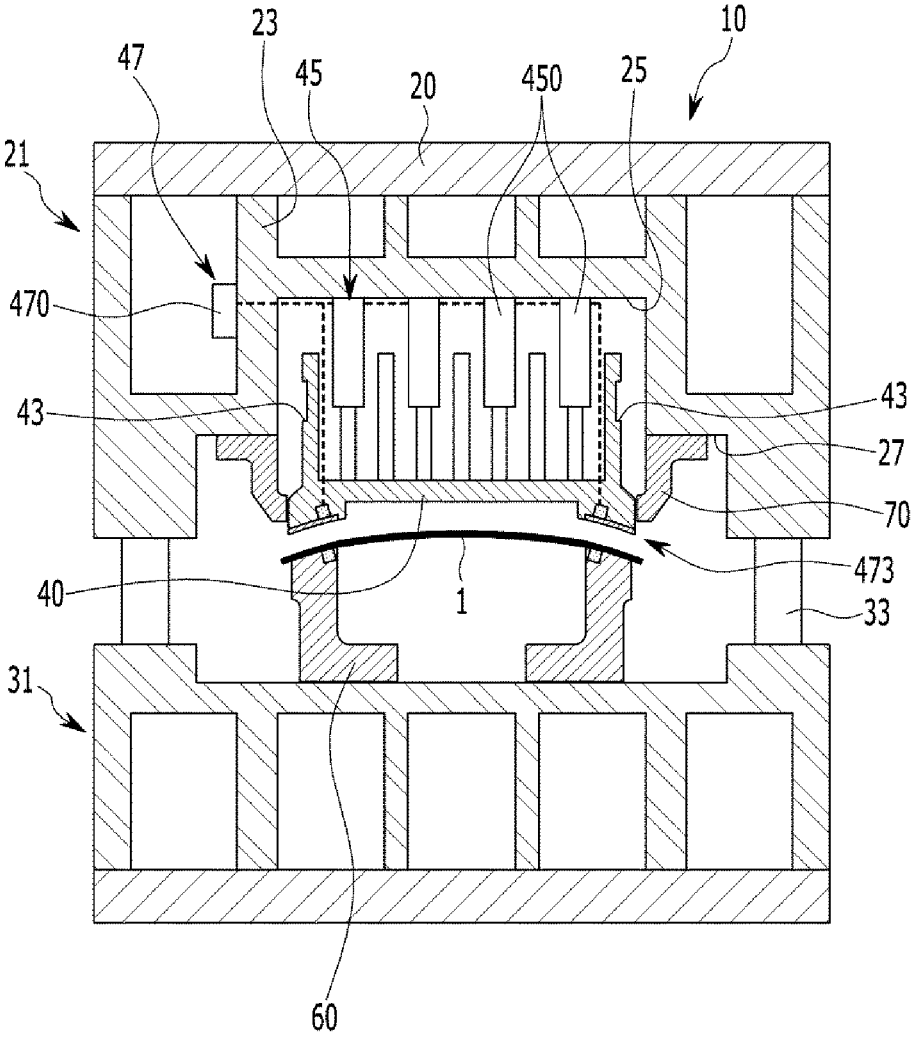
FIG. 2, FIG. 3, FIG. 4 and FIG. 5 are operation diagrams sequentially showing the operation of a press mold according to various exemplary embodiments of the present invention.

Referring to FIG. 2, the upper die 21 is separated from the lower die 31 by the upper press 20.

The panel 1 is loaded on the lower forming surface 61 of the lower steel 60.

At the present time, the gas spring 450 and the urethane pad 50 remain apart from the lower steel 60 and the panel 1.

For example, the gap between the upper forming surface 49 and the lower forming surface 61 may be maintained to 7 mm.

Figure 3:
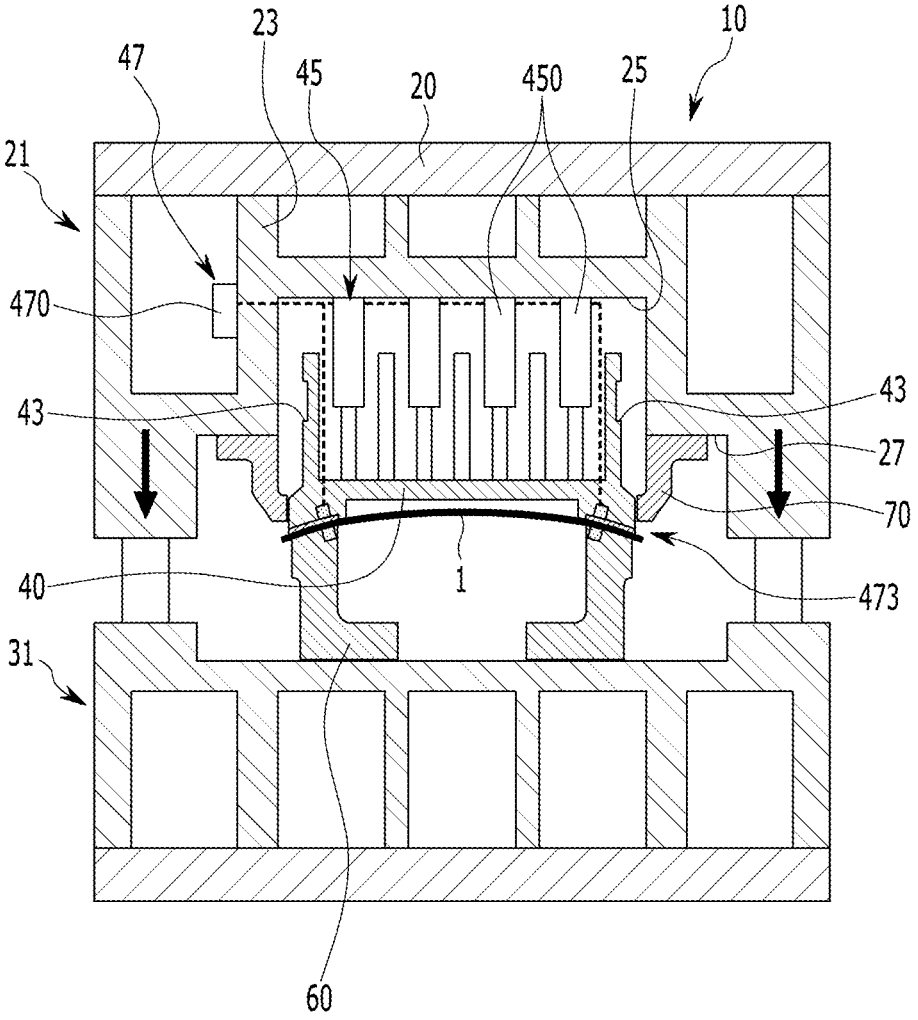

Referring to FIG. 3, by the operation of the upper press 20, the upper die 21 descends toward the lower die 31 until the urethane pad 50 contacts with the panel 1.

Figure 4:
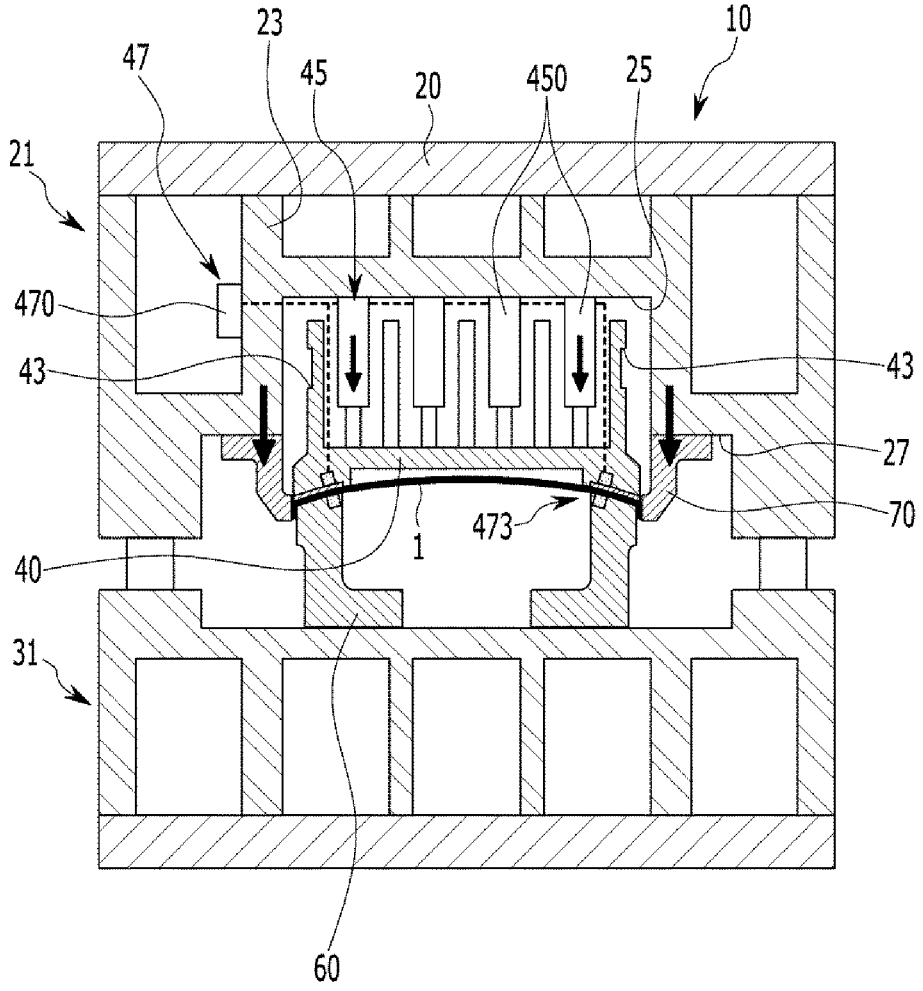

Referring to FIG. 4, by the upper press 20, the upper die 21 and the upper pad 40 further descend together.

For example, the gap between the upper forming surface 49 and the lower forming surface 61 may be maintained to 6.5 mm.

At the present time, when the gap is greater than the reference value of 6.5 mm, this indicates an insufficient pressure of the gas spring 450, and the pressure control device 47 supplies a required additional pressure to the gas spring 450. When the gap is smaller than the reference value of 6.5 mm, this indicates an excessive pressure of the gas spring 450, and the pressure control device 47 operates to exhaust an excessive pressure of the gas spring 450.

The urethane pad 50 is compressed between the upper forming surface 49 and the lower forming surface 61, and thereby a fixing force is applied to the panel 1. In such a state, the upper steel 70 descends along the external surface of the lower steel 60, and thereby the panel 1 may be formed by the external shape forming surface 71.

At the present time, the formed part on the panel 1 is called as a formed surface.

Figure 5:
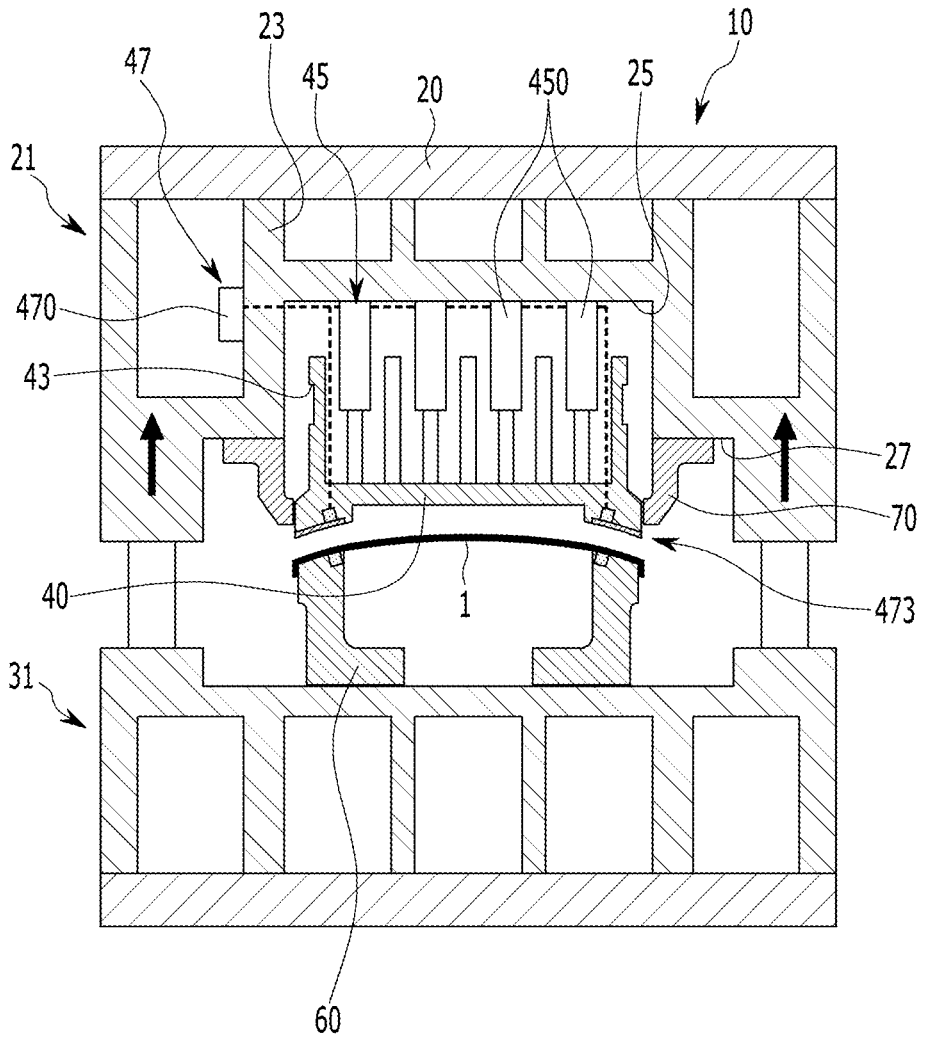

Subsequently, as shown in FIG. 5, the upper die 21 and the upper pad 40 are raised by the upper press 20 to return to an initial state.

Therefore, according to the press mold 10 according to various exemplary embodiments of the present invention, the urethane pad 50 is formed along the upper forming surface 49 that directly contacts with the panel 1, and thereby a perfect match is achieved between the panel 1, the upper forming surface 49, and the lower forming surface 61. Therefore, possibility of defect of the formed surface may be prevented, and a manual post-processing is not necessary.

Accordingly, the press mold 10 according to various exemplary embodiments of the present invention may enable fully automated forming of the panel 1.

Due to the provided configuration, the press mold 10 may improve quality while reducing work man-hours and labor costs.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A press mold for forming a panel, the press mold comprising:

an upper die for vertically operating by an upper press, and having a mounting recess recessed upward at a lower surface central portion of the upper die;

a lower die disposed under the upper die;

an upper pad disposed in a center portion of the mounting recess, and formed with an upper forming surface at a lower surface edge portion of the upper pad;

a lower steel disposed under the upper pad, mounted on the lower die, and formed with a lower forming surface at an upper surface edge portion of the lower steel corresponding to the upper forming surface; and an upper steel mounted on the upper die at a position exterior to the lower forming surface, wherein the upper pad is elastically supported in a vertical direction by an elastic unit mounted in the mounting recess and configured to apply a pressure to the panel by the elastic unit, wherein the elastic unit includes a plurality of gas springs of which pressure is adjusted by a pressure control device, and wherein the pressure control device includes:

a controller mounted in an internal side of the upper die;

a plurality of pipes connected to the controller and to the plurality of gas springs; and a sensing portion connected to the controller through the plurality of pipes, and configured to detect a gap between the upper forming surface and the lower forming surface.

2. The press mold of claim 1, wherein a urethane pad of a preset thickness is formed on the upper forming surface to contact with the panel.

3. The press mold of claim 2, wherein the preset thickness is set in a range of 5 mm to 15 mm.

4. The press mold of claim 2, wherein the urethane pad is formed on the upper forming surface to preset thickness by 3D printing.

5. The press mold of claim 4, wherein the urethane pad is bonded on the upper forming surface through a heat-resistant adhesive member that withstands a temperature range of 100° C. to 400° C.

6. The press mold of claim 2, wherein a plurality of filling grooves is formed on the upper forming surface of the upper pad to form a surface roughness.

7. The press mold of claim 6, wherein the plurality of filling grooves is filled with a urethane material.

8. The press mold of claim 6, wherein the plurality of filling grooves is formed in a slot shape and arranged in parallel in a direction toward a center portion of the upper pad.

9. The press mold of claim 1, wherein the upper pad is externally formed with a position regulation recess on a lateral side of the upper pad, and wherein a side pin is mounted in an internal side of the upper die and detachably coupled with the position regulation recess to regulate a vertical position of the upper pad.

10. The press mold of claim 1, wherein the upper steel is fitted to an outside of the lower steel, and formed with an external shape forming surface at an internal side to form an external shape of the panel.

11. The press mold of claim 1, wherein the upper steel is mounted on a stepped surface stepped downwardly from the mounting recess, and vertically movable along an external surface of the lower steel together with the upper die.

12. The press mold of claim 1, wherein a damping member is mounted between the upper die and the lower die to prevent direct contact between the upper die and the lower die.

13. A press mold for forming a panel, the press mold comprising:

an upper die for vertically operating by an upper press, and having a mounting recess recessed upward at a lower surface central portion of the upper die;

a lower die disposed under the upper die;

an upper pad disposed in a center portion of the mounting recess, and formed with an upper forming surface at a lower surface edge portion of the upper pad;

a lower steel disposed under the upper pad, mounted on the lower die, and formed with a lower forming surface at an upper surface edge portion of the lower steel corresponding to the upper forming surface; and an upper steel mounted on the upper die at a position exterior to the lower forming surface, wherein the upper pad is externally formed with a position regulation recess on a lateral side of the upper pad, and wherein a side pin is mounted in an internal side of the upper die and detachably coupled with the position regulation recess to regulate a vertical position of the upper pad.

14. A press mold for forming a panel, the press mold comprising:

an upper die for vertically operating by an upper press, and having a mounting recess recessed upward at a lower surface central portion of the upper die;

a lower die disposed under the upper die;

an upper pad disposed in a center portion of the mounting recess, and formed with an upper forming surface at a lower surface edge portion of the upper pad;

a lower steel disposed under the upper pad, mounted on the lower die, and formed with a lower forming surface at an upper surface edge portion of the lower steel corresponding to the upper forming surface; and an upper steel mounted on the upper die at a position exterior to the lower forming surface, wherein a damping member is mounted between the upper die and the lower die to prevent direct contact between the upper die and the lower die.

15. The press mold of claim 14, wherein the upper pad is externally formed with a position regulation recess on a lateral side of the upper pad, and wherein a side pin is mounted in an internal side of the upper die and detachably coupled with the position regulation recess to regulate a vertical position of the upper pad.

* * * * *